US006073928A

United States Patent [19]

Yamaguchi

[11] Patent Number: 6,073,928

[45] Date of Patent: Jun. 13, 2000

[54] SHEET END DETECTING MECHANISM

[75] Inventor: Kazuhiko Yamaguchi, Nagano, Japan

[73] Assignee: Seiko Espon Corporation, Tokyo, Japan

[21] Appl. No.: 09/019,979

[22] Filed: Feb. 6, 1998

[30] Foreign Application Priority Data

Feb. 6, 1997 [JP] Japan ..... 9-038309

[51] Int. Cl.[7] ..... B65H 5/00

[52] U.S. Cl. ..... 271/259; 271/262; 271/265.02

[58] Field of Search ..... 271/3.17, 4.03, 271/10.03, 259, 262, 265.02

[56] References Cited

U.S. PATENT DOCUMENTS

| | | | |
|---|---|---|---|
| 4,021,710 | 5/1977 | Fichte et al. | 271/159 X |
| 5,062,726 | 11/1991 | Inomata et al. | 400/630 |
| 5,540,425 | 7/1996 | Graef et al. | 271/250 X |
| 5,649,697 | 7/1997 | Kurishita et al. | 271/97 |

FOREIGN PATENT DOCUMENTS

| | | |
|---|---|---|
| 60-257275 | 12/1985 | Japan . |
| 63-031781 | 2/1988 | Japan . |
| 363185749A | 8/1988 | Japan . |
| 404075051A | 3/1992 | Japan . |
| 6-035276 | 2/1994 | Japan . |
| 7-125344 | 5/1995 | Japan . |
| 407327111A | 12/1995 | Japan . |

*Primary Examiner*—Christopher P. Ellis
*Assistant Examiner*—Patrick Mackey
*Attorney, Agent, or Firm*—Stroock & Stroock & Lavan LLP

[57] ABSTRACT

A sheet end detecting mechanism incudes: an optical-type sheet detector which is sensitive to a reflected light from a recording sheet surface is disposed at a slightly upper-path-side part of the printing position in a sheet conveyance direction; and an auxiliary mechanical-type sheet end detector which is displaced by passing of a recording sheet is disposed on the upper path side of the sheet detecting means.

2 Claims, 3 Drawing Sheets

SHEET END DETECTING MECHANISM

BACKGROUND OF INVENTION

The present invention relates to a sheet end detecting mechanism which is disposed in a sheet conveyance path of a printer.

A printer which prints a full color image on a sheet of designated-type of paper, for instance, requires such a performance as printing of the image fully from one end to the other end of the sheet, which accordingly requires a sheet detecting sensor that accurately detects a front end of or a rear end of the sheet.

The printer usually utilizes a mechanical sheet detecting sensor which is displaced by passing of the recording sheet and an optical sheet detecting sensor which is sensitive to the reflected light from the recording sheet surface; the mechanical sheet detecting sensor, however, wherein a tip of a detecting lever is bent in an obtuse angle for prevention of being caught when the recording sheet is fed reversely, is inconvenient with a low sheet detecting sensitivity, such as errors of ±several millimeters, whereas the optical sheet detecting sensor has a problem of imperfect sheet end detection of such a sheet as is framed, and thus neither is fully adequate to printing without margins.

SUMMARY OF INVENTION

In view of such problems as described above, the present invention is purposed to provide a new sheet end detecting mechanism which can greatly improve the sheet end detecting accuracy with utilization of existing sheet detecting sensors.

In a sheet end detecting mechanism of the present invention as a solution to such problems as described above, an optical-type sheet detecting means which is sensitive to a reflected light from a recording sheet surface is disposed at a slightly upper-path-side part of the printing position in a sheet conveyance direction and also by an auxiliary mechanical-type sheet end detecting means which is displaced by passing of a recording sheet is disposed on the upper path side of this sheet detecting means.

According to the sheet end detecting mechanism of the present invention, the optical-type sheet detecting means is appropriated to normal recording sheets while the mechanical-type sheet detecting means is appropriated to the other recording sheets that the optical-type sheet detecting means is unavailable for, such as solid black sheets.

DETAILED DESCRIPTION OF PREFERRED EMBODIMENTS

Embodiments of the present invention will now be described.

Figure 1:
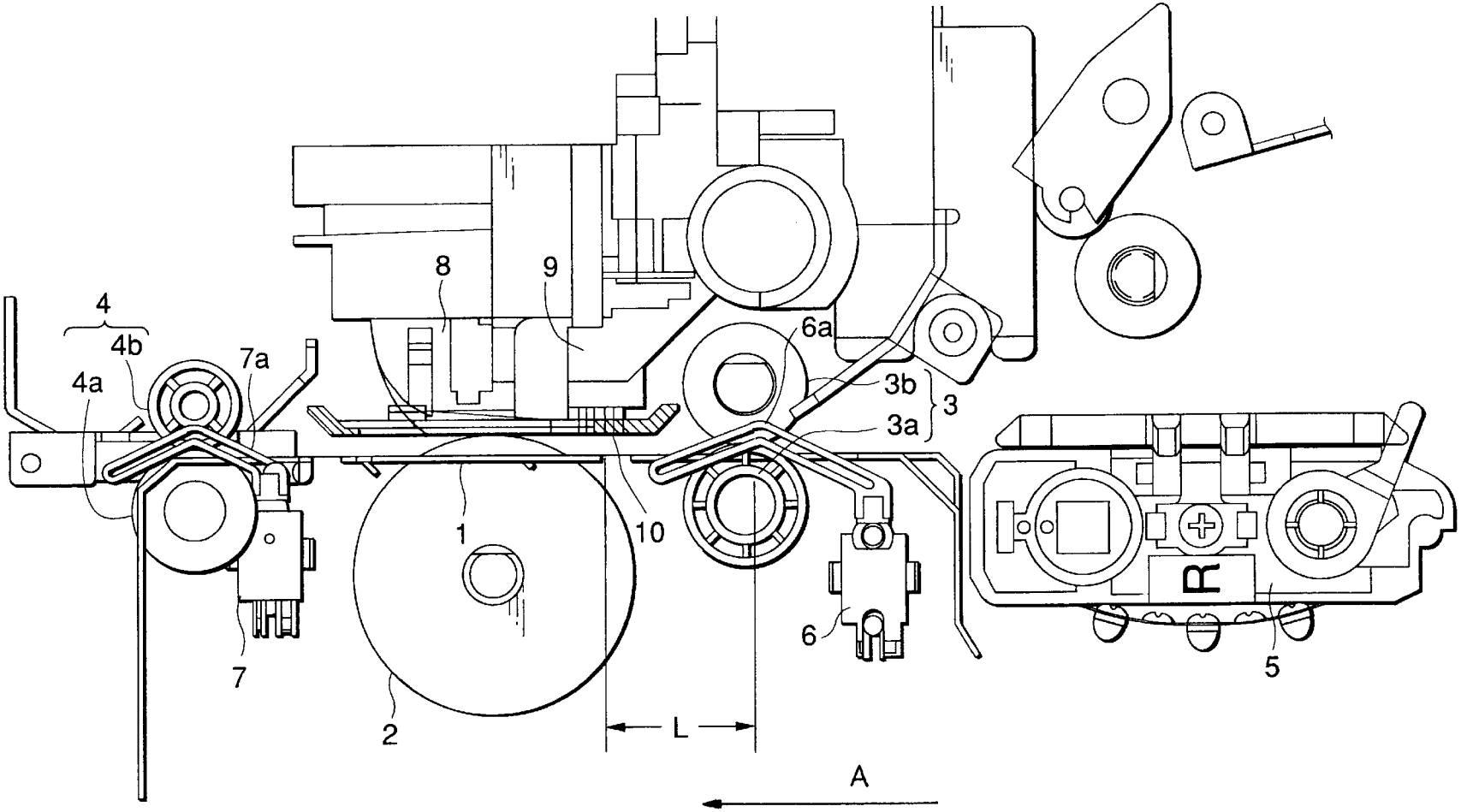
FIG. 1 is a lateral side view of a printer which comprises the sheet end detecting mechanism as an embodiment of the present invention.

FIG. 1 shows an embodiment of the present invention as an application to an impact-dot-type printer.

As shown in the drawing, a first pair and a second pair of sheet feed rollers 3 and 4 which include driving rollers 3*a* and 4*a* and driven rollers 3*b* and 4*b* are disposed on a sheet guide plate 1 respectively on the upper and the lower path sides in the sheet conveyance direction, as indicated by arrow A in FIG. 1 so as to hold a platen roller 2 between them and, sheet pick-up rollers (not shown in the figure) for feeding of cut sheets to a recording head 8 via the pair of sheet feed rollers 3 and a push tractor 5 for feeding of continuous sheets to the recording head 8 are disposed on the upper path side of the first pair of sheet feed rollers 3 which are a pair of sheet feed rollers on the upper path side in the sheet conveyance direction.

A first and a second mechanical sheet end detecting sensors 6 and 7 are disposed in the vicinities of where the aforenamed first and second pairs of sheet feed rollers 3 and 4 are disposed and, of these sheet end detecting sensors 6 and 7, the first sheet end detecting sensor 6 has a structure as an auxiliary sheet end sensor which controls a subsequent sheet conveyance depending on a detection signal only in a case where an optical sheet detecting sensor 10 which will be described below has failed to detect a recording sheet; and angled parts of detecting levers 6*a* and 7*a* of the sheet end detecting sensors 6 and 7, which are bent in an obtuse angle at their ends, are exposed over the sheet guide plate 1 so as to respectively match nipping parts of the first and second pairs of sheet feed rollers 3 and 4.

In this structure, on the other hand, the optical sheet detecting sensor 10 which is sensitive to a reflected light from the recording sheet surface is attached to a part of a carriage 9 for carrying the recording head 8, which is on the upper path side in the sheet conveyance direction, and, if the recording sheet is detected, the subsequent sheet conveyance control is carried out with the detection signal thereof while, if the recording sheet is not detected, the subsequent sheet conveyance control is carried out with the detection signal from the first mechanical sheet detecting sensor 6 based on a determination as a solid black sheet.

With references to flow charts in FIGS. 2 through 4, detecting operations of the sheet end detecting mechanism with such structure as above will now be described.

Figure 2:
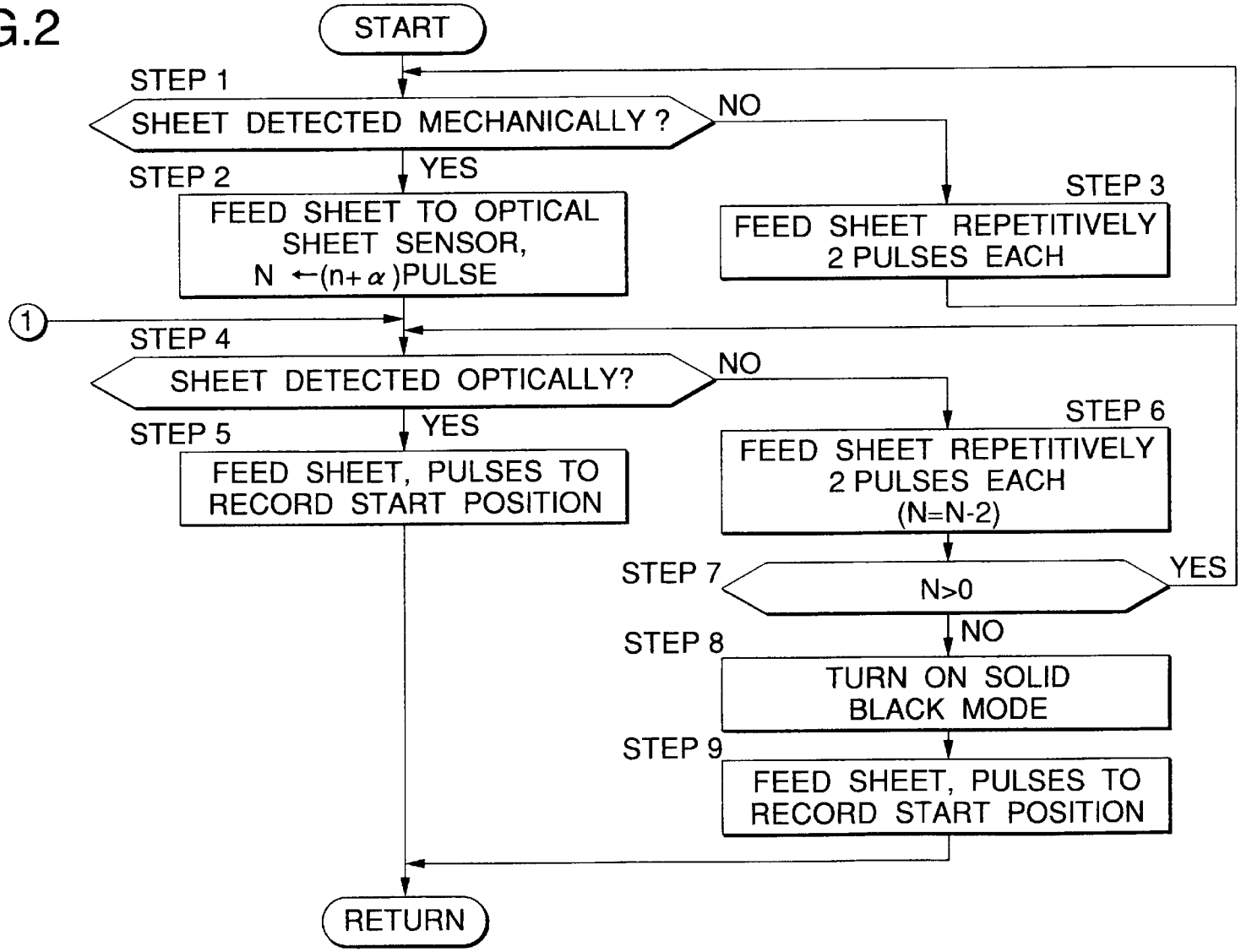
FIG. 2 is a flow chart which shows the sheet conveyance control actions for the continuous sheets with utilization of the same sheet end detecting mechanism as above.

FIG. 2 shows a case of continuous sheets as the object of detection, wherein operation of an operation button on a panel (not shown in the figure) feeds continuous sheets to the first mechanical sheet end detecting sensor 6 which is provided in the vicinity of the first pair of sheet feed rollers 3 so that a displacement of the detection lever 6*a* with a tip thereof will detect this (step 1) while, in case of no output of the detection signal, the continuous sheets are fed repetitively for two pulses each time (step 3) till this is detected (step 1).

After output of the detection signal from the first mechanical sheet end detecting sensor 6, the continuous sheets are fed by as many pulses ($n+\alpha$) as a number which is slightly larger than the number of pulses (n) which is equivalent to a distance L from this position to the optical sheet detecting sensor 10 (step 2) and, after waiting for a detection signal from the optical sheet detecting sensor 10 with input of the pulse number ($n+\alpha$) to a counter N (step 4), a recording start part of the continuous sheet is fed to a position exactly below the recording head 8 with the pulses equivalent to the distance from this position to the initiating position (step 5).

On the contrary, if a front end of the continuous sheet has not been detected by the optical sheet detecting sensor 10 at step 4, the sheet feeding is carried out repetitively for two pulses each time (step 6); if there is no output of the detection signal after feeding of (n+α) pulses, or, if the counter N does not indicate a positive number (step 7), it is determined as to be in a SOLID BLACK mode (step 8) and the recording start part of the continuous sheet is fed from this position, which is a position where the position whereas the first mechanical sheet end detecting sensor 6 is disposed is a reference point, to a position exactly below the recording head 8 for as many pulses as equivalent to the distance to the initiating position in the SOLID BLACK mode which is a mode that is based on the detection signal of the mechanical sheet end detection sensor 6 (step 9).

Figure 3:
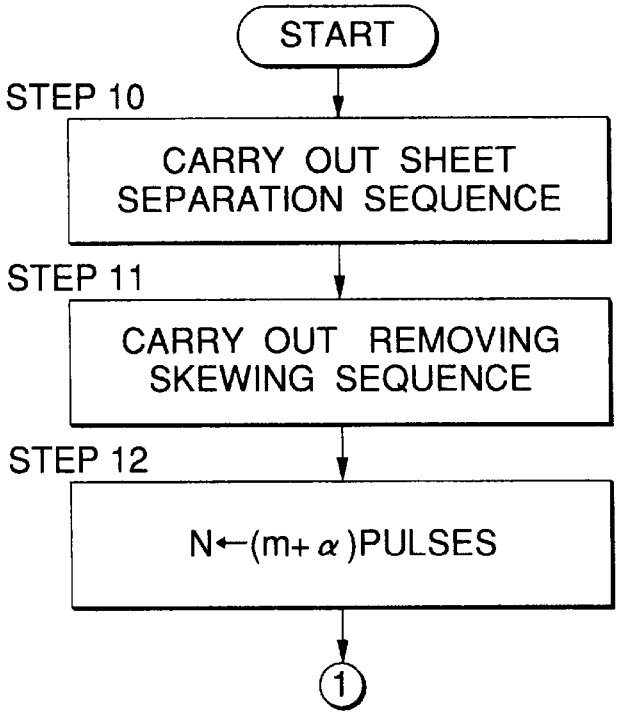
FIG. 3 is a flow chart which shows the sheet conveyance control actions for the cut sheets.

On the other hand, when cut sheets are the object of detection, as shown in FIG. 3, a cut sheet which has been aligned via a sheet separation sequence (step 10) and a de-skewing sequence (step 11) is fed for as much as the number of pulses (m+α) which is slightly larger than the number of pulses (m) which is equivalent to the distance from the nipping point of the pick-up rollers to the optical sheet detecting sensor 10 (step 12) and then the recording sheet control is carried out at the steps subsequent to the step 4. After feeding of the number of pulses (m+α) which is slightly larger than the number of pulses (m) which is equivalent to the distance to zero (step 12) and then the recording sheet control is carried out at the steps subsequent to the step 4.

Figure 4:
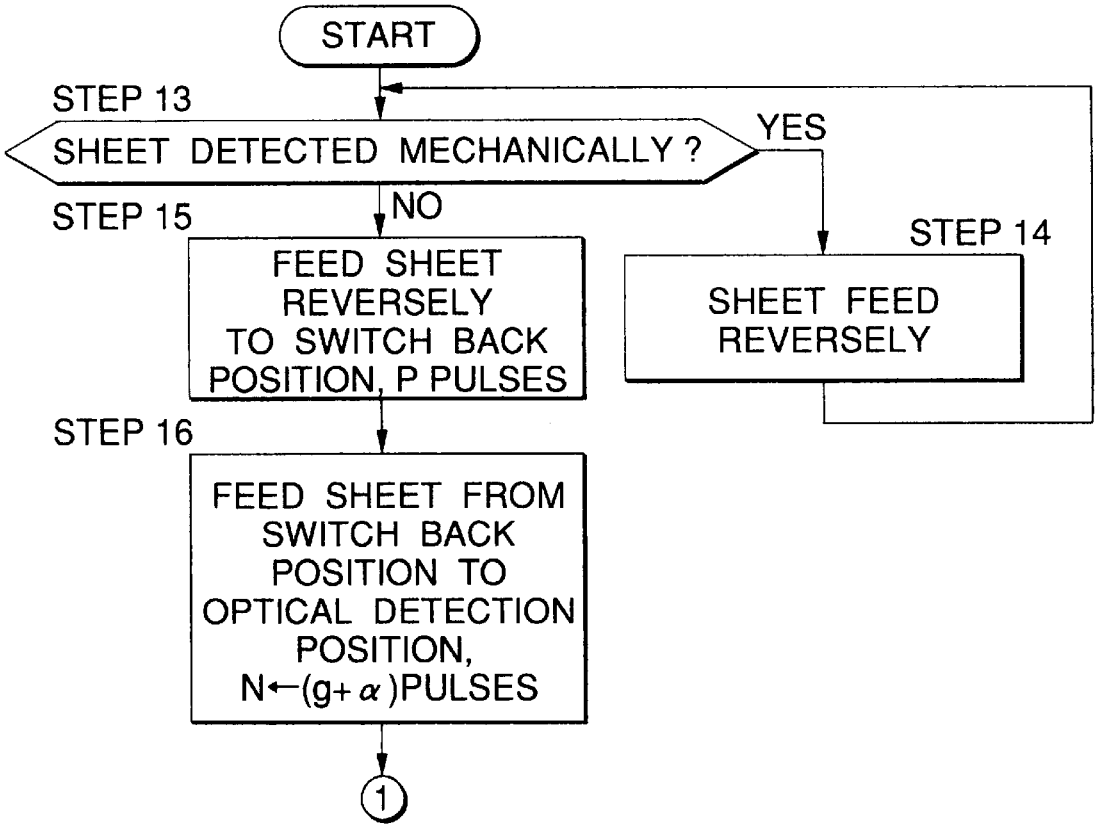
FIG. 4 is a flow chart which shows the sheet conveyance control actions for the manually-fed sheets.

In a case of printing on narrow sheets, such as a post card, the recording sheet is fed manually from the sheet discharge side which is the left side in FIG. 1 till the front end comes into contact with the second sheet feed rollers 4, as shown in FIG. 4, and then fed reversely further beyond this contact point (step 14); when output of the detection signal from the second mechanical sheet end detecting sensor 7 stops (step 13), reverse feeding is carried out for as much as the number of pulses (p) which is equivalent to the distance from the nipping point of the second sheet feed rollers 4 to the switch back position (step 15) and, after the recording sheet is fed forward for as much as the number of pulses (g+α) which is slightly larger than the number of pulses (g) which is equivalent to the distance from this point to the optical sheet detecting sensor 10, the detection signal from the optical sheet detecting sensor 10 is waited for to carry out the sheet feed control at the steps from the above-described step 4 to the step 9.

In accordance with the present invention, as discussed above, since the optical-type sheet detecting means is disposed on the upper path side of the printing position in the sheet conveyance direction whereas the auxiliary mechanical-type sheet detecting means is disposed on the further upper path side thereof, the sheet conveyance control of the normal recording sheets is carried out with the detection output from the optical-type sheet detecting means of a high detecting accuracy while the sheet conveyance control of the other recording sheets which cannot be detected by the optical-type sheet detecting means, such as a solid black sheet, is carried out with the compensatory use of the mechanical-type sheet detecting means wherein the detecting accuracy is slightly inferior; thus the strong points of the optical-type and the mechanical-type sheet detecting means are respectively utilized to compensate their weak points so as to carry out accurate sheet conveyance.

Furthermore, the optical-type sheet detecting means which is disposed on the carriage enables simultaneous detection of a width of the recording sheet being fed as well as the sheet conveyance control.

What is claimed is:

1. A sheet end detecting mechanism for use in a printing device for detecting an end of a recording sheet and for controlling the conveyance of the recording sheet and a subsequent recording sheet as the recording sheets are moved through the printing device by rollers, said mechanism comprising:

optical detecting means for detecting an end of a first type of recording sheet and for controlling the conveyance in a sheet conveyance direction of a subsequent first type of recording sheet, said optical detecting means detecting a reflected light from a surface of the first type of recording sheet and which is disposed at a slightly upper-path-side of a printing position in the printing device in the sheet conveyance direction;

a first mechanical detecting means for detecting an end of a second type of recording sheet and for controlling conveyance in the sheet conveyance direction of a subsequent second type of recording sheet when said optical detecting means does not detect the first type of recording sheet, said first mechanical detecting means being displaced by passing of the second type of recording sheet therethrough and being disposed on the upper-path-side of said optical detecting means; and a second mechanical detecting means for detecting an end of the second type of recording sheet moved in a direction opposite of the sheet conveyance direction and for controlling conveyance in the opposite direction of a subsequent second type of recording sheet when said optical detecting means does not detect the first type of recording sheet, said second mechanical detecting means being displaced by passing of the second type of recording sheet therethrough and being disposed on a lower-path-side of said optical detecting means.

2. The sheet end detecting mechanism according to claim 1, wherein said optical sheet detecting means is disposed on a carriage which moves sideways reciprocally.

* * * * *